US005160126A

United States Patent [19]

Atkinson

[11] Patent Number: 5,160,126

[45] Date of Patent: Nov. 3, 1992

[54] CABINET MOUNTING APPARATUS

[76] Inventor: Peter Atkinson, 536 Leetes Island Rd., Branford, Conn. 06405

[21] Appl. No.: 837,941

[22] Filed: Feb. 20, 1992

[51] Int. Cl.[5] ..... B25B 5/14

[52] U.S. Cl. ..... 269/102; 269/306; 269/904

[58] Field of Search ..... 248/542, 247; 269/904, 269/37, 41, 43, 307, 102, 306, 45

[56] References Cited

U.S. PATENT DOCUMENTS

| | | | |
|---|---|---|---|
| 3,085,693 | 4/1963 | Shell | 248/248 |
| 3,268,195 | 8/1966 | Hoffman | 248/247 |
| 3,311,435 | 3/1967 | Heritage | 248/542 |
| 4,093,202 | 6/1978 | Kincaid | 269/904 |
| 4,254,945 | 3/1981 | Paulson et al. | 269/904 |
| 4,600,183 | 7/1986 | Ogden | 269/43 |
| 4,715,760 | 12/1987 | Browning | 269/904 |
| 4,786,038 | 11/1988 | Ammons | 269/904 |

*Primary Examiner*—Robert C. Watson
*Attorney, Agent, or Firm*—Leon Gilden

[57] ABSTRACT

An anchor plate is arranged for cooperation with an underlying mounting plate to position a cabinet therebetween, wherein the anchor plate includes in a first embodiment a slide block mounted within a slot within the anchor plate, and the slide block hingedly mounting a mounting leg, including a flange for abutment with a forward surface of the cabinet for positioning the cabinet during a mounting procedure. A modification of the invention includes a generally serpentine securement leg slidably mounted within a channel defined by an anchor plate structure, wherein the securement leg includes a plurality of spaced abutments arranged in a parallel relationship to provide for positioning of the cabinet in communication with one of said abutments for positioning the cabinet during a mounting procedure. A modification of the securement leg includes abutment plunger rods reciprocatably mounted to at least one if not both of the abutment plates to enhance positioning and securement of the securement leg relative to the cabinet structure during mounting.

8 Claims, 5 Drawing Sheets

CABINET MOUNTING APPARATUS

BACKGROUND OF THE INVENTION

1. Field of the Invention

The field of invention relates to workpiece support apparatus, and more particularly pertains to a new and improved cabinet mounting apparatus wherein the same is arranged for the positioning and alignment of a cabinet during mounting of the cabinet to a vertical wall surface.

2. Description of the Prior Art

Mounting of cabinets to a vertical wall surface typically requires a plurality of individuals to accomplish the task by positioning the cabinet during a mounting procedure. The instant invention attempts to overcome deficiencies of the prior art by providing for cooperating bracket structure to position a cabinet therebetween, where the forward projecting securement leg is arranged for support of the cabinet during a mounting procedure.

Examples of prior art work support apparatus is exemplified in U.S. Pat. No. 4,294,441 to O'Banion, et. al. setting forth cooperating jaws for securement of a workpiece therebetween.

U.S. Pat. No. 4,786,038 to Ammons sets forth a tool structure clamped to a vertical wall stud arranged to provide an abutment surface for positioning an overlying mounting stud thereon.

U.S. Pat. No. 4,128,234 to McKee provides for a cabinet installation tool arranged to provide for an underlying support of an overlying cabinet structure.

As such, it may be appreciated that there continues to be a need for a new and improved cabinet mounting apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of cabinet mounting apparatus now present in the prior art, the present invention provides a cabinet mounting apparatus wherein the same utilizes opposed and spaced parallel bracket structure to position and secure a cabinet therebetween during a mounting procedure. As such, the general purpose of the present invention, which will be described subsequently in greater detail, is to provide a new and improved cabinet mounting structure which has all the advantages of the prior art cabinet mounting structure and none of the disadvantages.

To attain this, the present invention provides an anchor plate arranged for cooperation with an underlying mounting plate to position a cabinet therebetween, wherein the anchor plate includes in a first embodiment a slide block mounted within a slot within the anchor plate, and the slide block hingedly mounting a mounting leg, including a flange for abutment with a forward surface of the cabinet for positioning the cabinet during a mounting procedure. A modification of the invention includes a generally serpentine securement leg slidably mounted within a channel defined by an anchor plate structure, wherein the securement leg includes a plurality of spaced abutments arranged in a parallel relationship to provide for positioning of the cabinet in communication with one of said abutments for positioning the cabinet during a mounting procedure. A modification of the securement leg includes abutment plunger rods reciprocatably mounted to at least one if not both of the abutment plates to enhance positioning and securement of the securement leg relative to the cabinet structure during mounting.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cabinet mounting apparatus which has all the advantages of the prior art cabinet mounting apparatus and none of the disadvantages.

It is another object of the present invention to provide a new and improved cabinet mounting apparatus which may be easily and efficiently manufactured and marketed.

It is a further object of the present invention to provide a new and improved cabinet mounting apparatus which is of a durable and reliable construction.

An even further object of the present invention is to provide a new and improved cabinet mounting apparatus which is susceptible of a low cost of manufacture with regard to both materials and labor, and which accordingly is then susceptible of low prices of sale to the consuming public, thereby making such cabinet mounting apparatus economically available to the buying public.

Still yet another object of the present invention is to provide a new and improved cabinet mounting apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
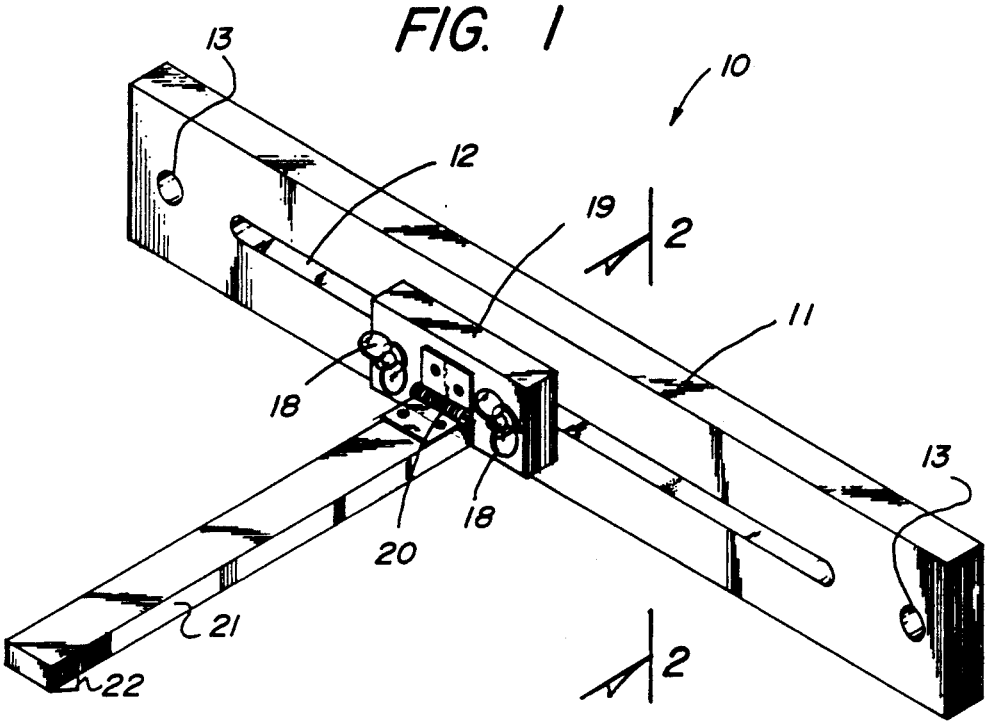
FIG. 1 is an isometric illustration of the instant invention.

With reference now to the drawings, and in particular to FIGS. 1 to 12 thereof, a new and improved cabinet mounting apparatus embodying the principles and concepts of the present invention and generally designated by the reference numerals 10, 10*a*, and 10*b* will be described.

Figure 2:
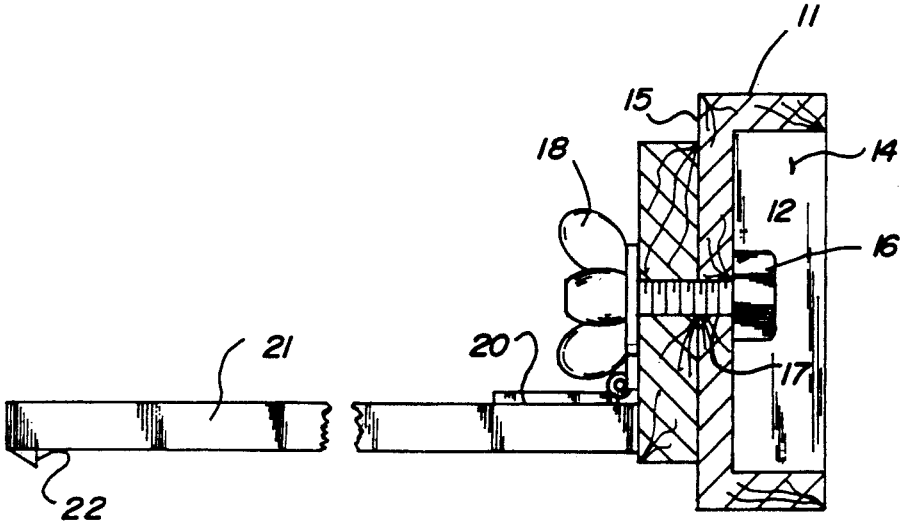
FIG. 2 is an orthographic view, taken along the lines 2—2 of FIG. 1 in the direction indicated by the arrows.
Figure 3:
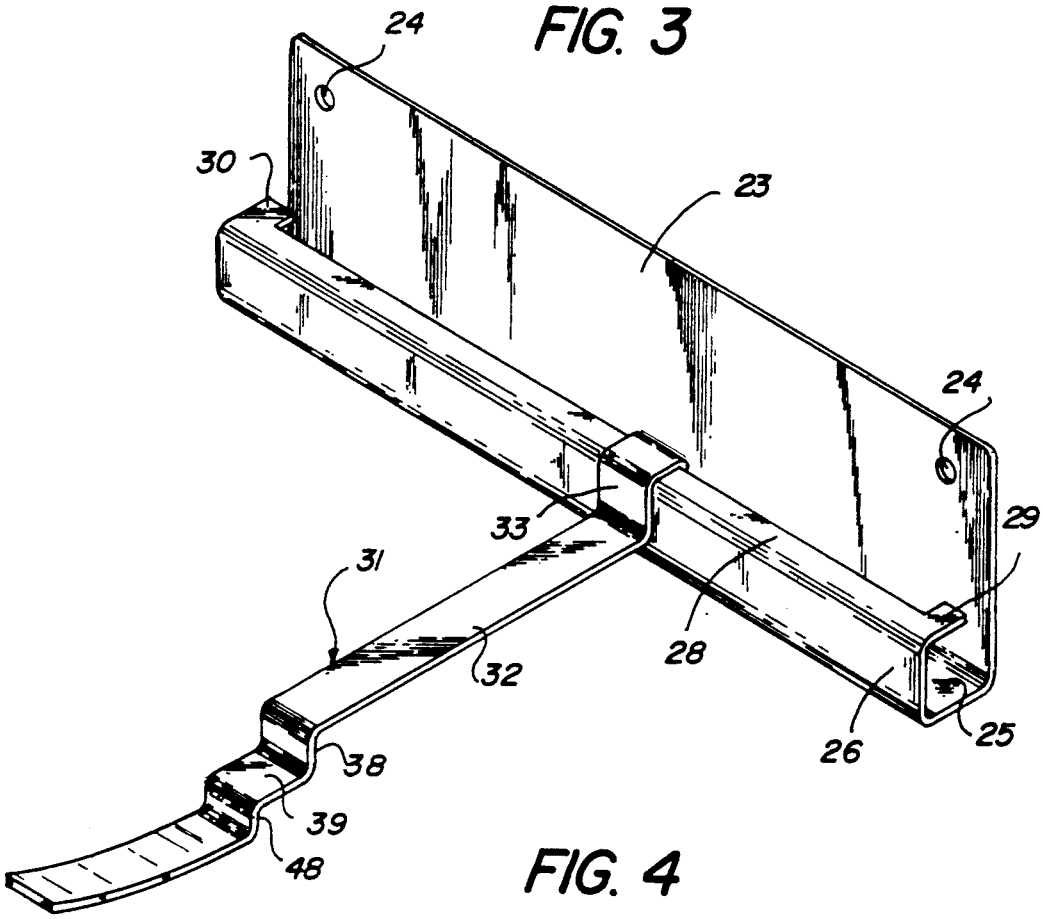
FIG. 3 is an isometric illustration of a modification of the invention.
Figure 4:
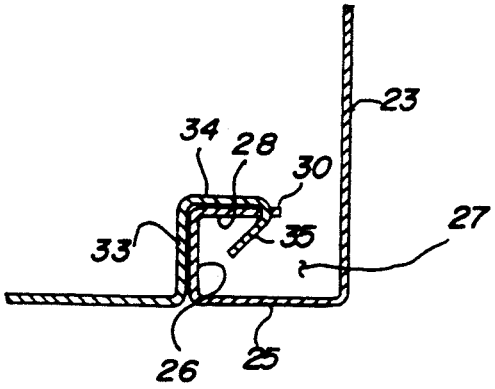
FIG. 4 is an orthographic cross-sectional illustration of the invention as set forth in FIG. 3.
Figure 5:
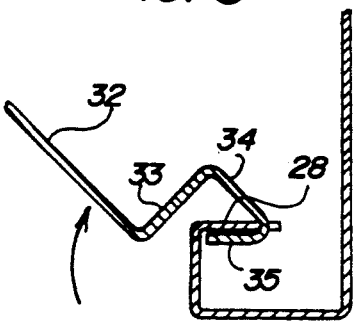
FIG. 5 is an orthographic view of the structure of FIG. 3 in a raised orientation.
Figure 6:
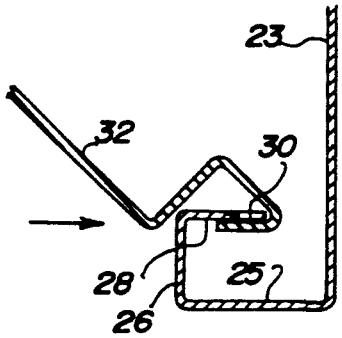
FIG. 6 is an orthographic cross-sectional view of the structure as set forth in the FIGS. 3–5 projecting the manual leg forwardly for ease of removal or mounting relative to the mounting plate structure.
Figure 10:
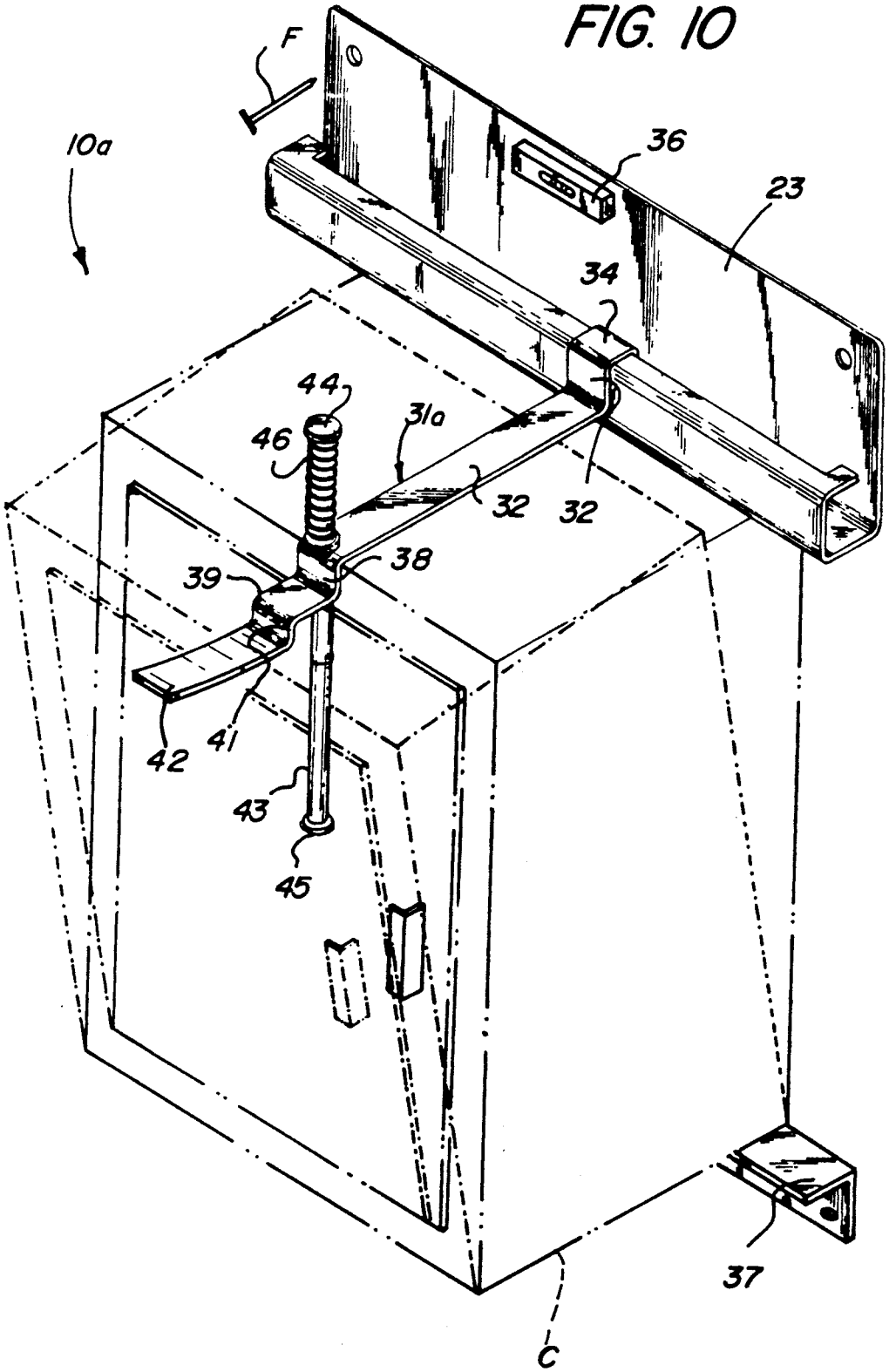
FIG. 10 is an isometric illustration of the invention in use.

More specifically, the cabinet mounting apparatus 10, as illustrated in the FIGS. 1 and 2, sets forth an anchor plate 11 formed with an enclosed slot 12 longitudinally aligned within the anchor plate 11, with the anchor plate further including a plurality of mounting bores 13 to receive fasteners "F", such as the type as illustrated in FIG. 10, to secure the anchor plate relative to a vertical wall surface above an associated cabinet "C". A fastener flange 16 includes an externally threaded boss 17 projecting through an associated slide block 19, with a securement member 18 threadedly secured about the boss, with the slide block 19 positioned between the securement member 18 and a front wall 15 of the anchor plate 11. The anchor plate includes the cavity 14 to receive the fastener flange 16 therewithin. As illustrated, a plurality of such securement members 18 in association with the boss flanges 17 and 16 respectively are provided and directed through the slide block 19, through the slot 12 into the cavity 14. A hinge 20 mounted to a forward surface of the slide block hingedly mounts a mounting leg 21 that is normally maintained in an orthogonal orientation forwardly of the slide block and the front wall 15, with a leg flange 22 projecting downwardly relative to a forward distal end of the mounting leg 21 to secure a cabinet "C" between the leg flange 22 and the associated vertical wall surface. The anchor plate 11 cooperates with a lower support plate 37 for mounting the cabinet "C" thereon, wherein the lower support plate 37 is arranged parallel and below the anchor plate 11 to position the cabinet "C" therebetween, in a manner as illustrated in FIG. 10.

In use, the cabinet "C" is positioned upon the lower support plate 37 and pivoted rearwardly into contiguous communication with a vertical wall surface, whereupon the mounting leg 21 is lifted by the cabinet "C" and thereafter drops into position to position the leg flange 22 in abutment with the forward surface of the cabinet "C".

The modified apparatus 10*a*, as illustrated in the FIGS. 3–10, includes a mounting plate 23 formed of a plurality of spaced mounting plate bores 24 arranged for receiving fasteners therethrough, such as illustrated in FIG. 10, wherein the mounting plate 23 includes a plate bottom wall 25 arranged in a parallel relationship relative to the lower support plate 37. The bottom wall 25 is defined by a predetermined first width, and includes an orthogonally mounted forward wall 26 extending upwardly from the bottom wall 25 in a parallel relationship relative to the mounting plate 23, and defined by a predetermined height. A channel 27 is defined between the plate 23, the bottom wall 25, the forward wall 26, and a mounting plate top wall 28 arranged parallel to and above the bottom wall 25 orthogonally mounted to a top edge of the forward wall 26. A right and left respective abutment leg 29 and 30 are coplanar with the top wall 28 and are mounted integrally thereto projecting towards the mounting plate 23 to provide abutment for an associated securement leg 31 that is slidably directed within the channel 27 and supported by the top wall 28 and the forward wall 26. The securement leg 31 includes a primary leg plate 32, with the primary leg plate 32 defined by a first length and orthogonally oriented relative to the forward wall 26 in use. The primary leg plate 32 may be pivoted upwardly for removal of the securement leg 31 relative to the forward and top walls 26 and 28. A first flange 33 is orthogonally and integrally mounted to a forward distal end of the primary leg plate 32 and is defined by a height substantially equal to the predetermined height of the forward wall 26. A second flange 37 orthogonally and integrally mounted projecting forwardly of the upper terminal edge of the first flange 33 is defined by a width substantially equal to the predetermined second width of the mounting top wall 28. It should be noted that the mounting plate top wall 28 is arranged in a spaced relationship relative to the mounting plate 23 defined by a predetermined distance. It should be noted that the predetermined second width of the top wall 28 is of a width less than a first width defined by the bottom wall 25 to thereby define a gap between the top wall 28 and the mounting plate 23, as illustrated. A third flange 25 defined by a width less than the predetermined distance is canted downwardly relative to the second flange 34 projecting towards the first flange 33 to permit selective assembly of the securement leg 31 relative to the mounting plate 23.

In this manner, the securement leg 31 may be slid as required between the right and left abutment legs 29 and 30.

A spirit level 36 is mounted in the aspect of the invention as illustrated in FIG. 10 to the mounting plate 23 to provide appropriate leveling of the mounting plate during use. A first cabinet abutment plate 38 is integrally and orthogonally mounted downwardly relative to a rear distal end of the primary leg plate 32, with a secondary leg plate 39 arranged parallel to the primary leg plate 32 extending rearwardly thereof and below the primary leg plate. A second cabinet abutment plate 41 orthogonally mounted to a rear distal end of the secondary leg plate 39 extends downwardly therefrom and arranged in a parallel relationship relative to the first cabinet abutment plate 38 and positioned therebelow. A plate 42 mounted integrally to a lower terminal edge of the second abutment plate 41 extends rearwardly thereof to cause leg 31 to be lifted by cabinet 'C' and to permit ease of manipulation of the securement leg 31.

Figure 7:
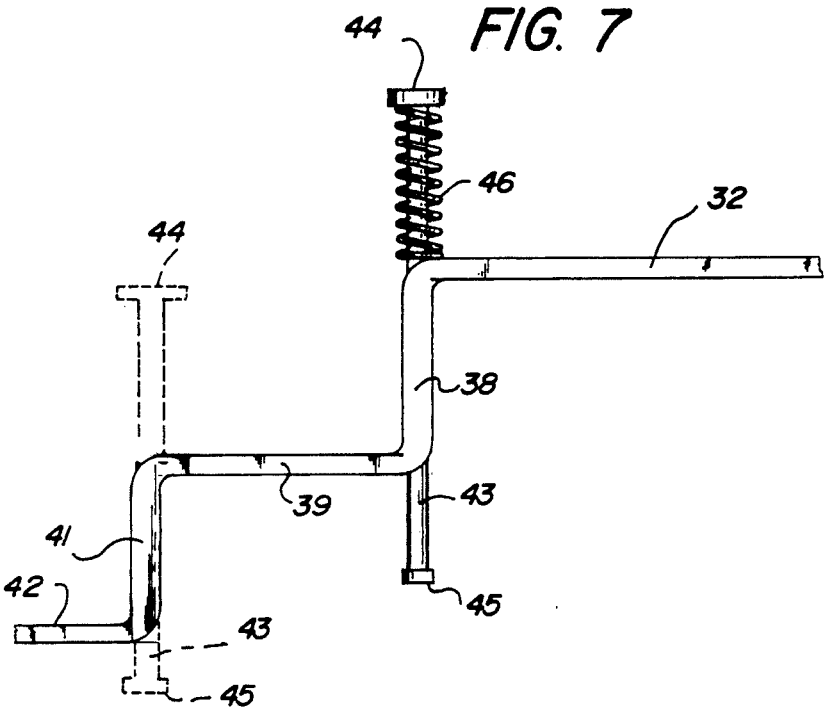
FIG. 7 is an orthographic side view of the securement leg, including an abutment plunger.
Figure 8:
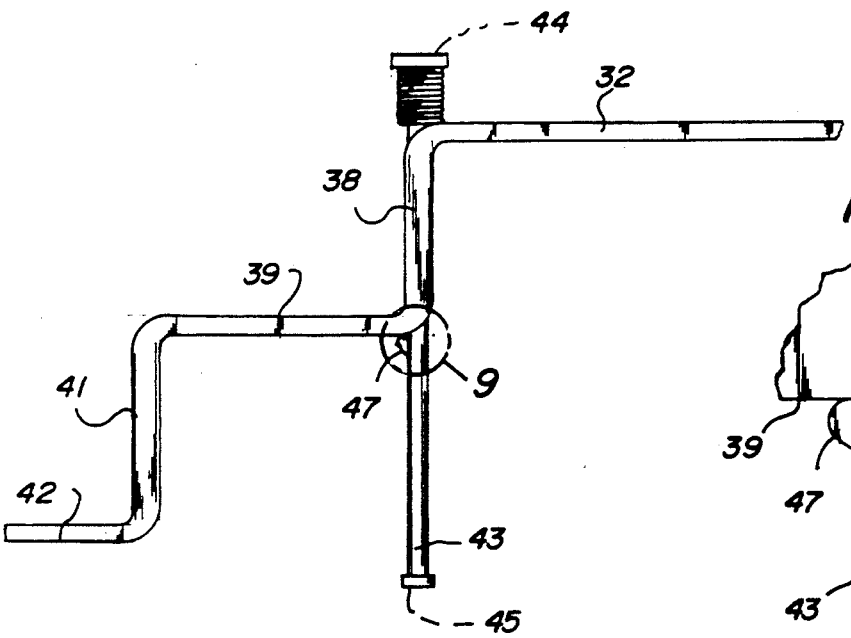
FIG. 8 is an orthographic side view of the securement leg with the abutment plunger in a lowered orientation.
Figure 9:
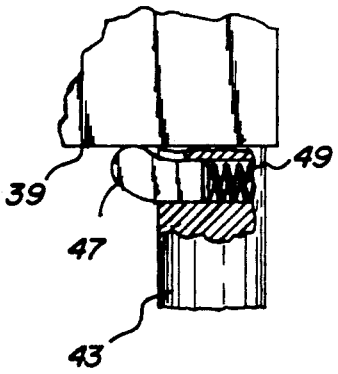
FIG. 9 is an enlarged orthographic view, partially in section, of the locking plunger structure of the abutment rod set forth in FIG. 8.

The apparatus, as illustrated in the FIGS. 7–10, further includes an optional abutment plunger rod 43 slidably directed through the first and second abutment plates 38 and 41 respectively. Each abutment plunger rod 43 is of identically construction and includes a top flange 44 mounted to an upper terminal end of the abutment plunger rod 43, with a bottom flange 45 mounted to a lower terminal end of the plunger rod 43, with a spring 46 captured between the top flange 44 and the first abutment plate 38 to maintain the plunger rod in a raised first position, as illustrated in FIG. 7. A locking lug 47 radially directed into the rod 43 is received within a plunger rod cavity 49, with a locking lug spring 48 positioned within the cavity to normally bias the locking lug 47 exteriorly thereof. In the second position as illustrated in FIG. 8, the rod 43 is directed downwardly through the abutment plate 38 permitting projecting of the locking lug 47 exteriorly of the rod 43 preventing raising of the rod to the first position, as illustrated in FIG. 7, until the locking rod 47 is depressed into the cavity 49 permitting the lifting of the rod. The plunger rod bore is directed through the abutment plate to permit sliding support of the abutment plate in use and as noted, the abutment rod 43 is oriented to project below a lower terminal end of an associated abutment plate to provide for an elongate abutment surface in mounting a cabinet "C" in position during a mounting procedure.

Figure 11:
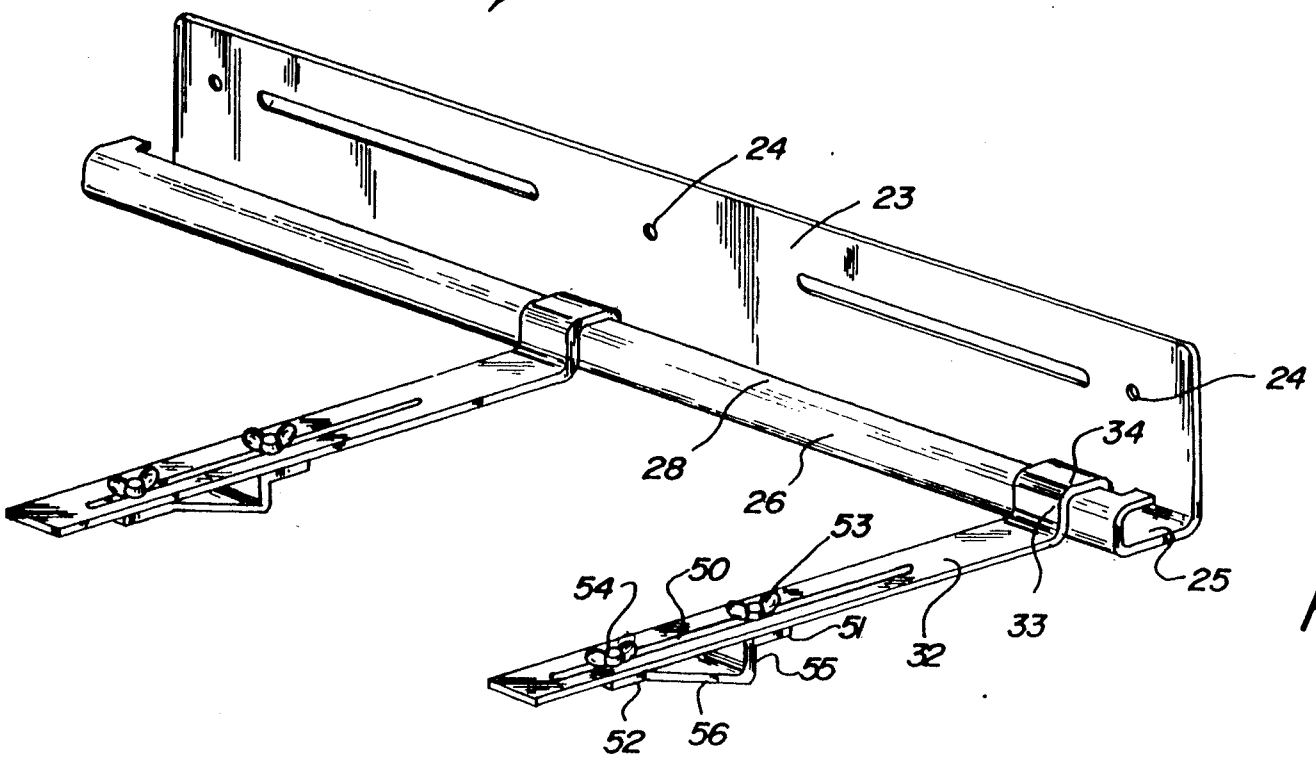
FIG. 11 is an isometric illustration of a further modification of the invention.
Figure 12:
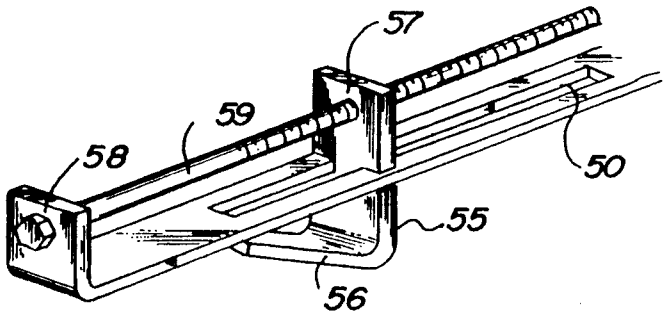
FIG. 12 is a detailed view of a modification of the abutment structure utilized by the invention as set forth in FIG. 11.

A further modification **10*b* of the invention as set forth in the FIG. 11 includes a primary leg plate 32 extending orthogonally and rearwardly relative to the first flange 33, and includes a leg slot 50 oriented parallel to the sides of the primary leg plate 32, with a first slide plate 11 and a second slide plate 12 in a coplanar relationship relative to one another in sliding relationship relative to a bottom surface of the primary leg plate 32. A first fastener 53 and a second fastener 54 are respectively directed through the leg slot 50 into selective securement with the respective first and second slide plates 51 and 52. An abutment flange 55 is orthogonally and integrally directed downwardly relative to the first slide plate 51, with the lifting plate 56 extending from the abutment flange 55 rearwardly to integral communication with the second slide plate 52. In this manner, the abutment plate 55 would be slid forwardly and rearwardly and in orthogonal alignment relative to the primary leg plate 32 for abutment with a forward wall of the cabinet structure of a type such as illustrated in FIG. 10**.

The modified primary leg plate 32, as illustrated in the FIG. 11, includes the abutment flange 55 oriented orthogonally relative to a bottom surface of the primary leg plate 32 as illustrated, with the support flange 56 extending at an oblique angle rearwardly relative thereto for communication with the bottom surface for providing a lifting plate and stability to the abutment flange as it is slidably mounted relative to the bottom surface of the primary leg plate 32. The abutment flange illustrated in FIG. 12 includes an abutment flange extension 57 extending coplanar with the abutment flange 55 above the primary leg plate 32 receiving in threaded communication therethrough an externally threaded rod 59. The externally threaded rod 59 is orthogonally directed through the abutment flange extension 57 and orthogonally through a primary leg plate flange 58 orthogonally and intergrally mounted to a rear distal end of the primary leg plate 32, wherein the primary leg plate flange 58 is arranged parallel relative to the abutment flange extension 57. In this manner, rotation of the externally threaded rod 59 permits relative reciprocation of the abutment flange 55 relative to the slot 50 for adjusting engagement of the abutment flange relative to the cabinet structure "C", as set forth in FIG. 10.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A cabinet mounting apparatus, comprising, a mounting plate, the mounting plate including a plurality of spaced bores directed therethrough, the mounting plate including a plate bottom wall integrally and orthogonally mounted to a lower edge of the mounting plate extending forwardly thereof defined by a predetermined first width, and a plate forward wall integrally and orthogonally mounted to a forward edge of the plate bottom wall arranged in a parallel, coextensive, and confronting relationship relative to the mounting plate, wherein the forward wall is defined by a predetermined height, and a mounting plate top wall integrally and orthogonally mounted to an upper edge of the forward wall extending towards the mounting plate in an orthogonal relationship spaced therefrom a predetermined distance, and a channel defined between the mounting plate, the bottom wall, the forward wall, and the top wall, and a securement leg pivotally mounted within the channel extending forwardly of the forward wall, wherein the securement leg includes at least one abutment plate spaced from the forward wall.

2. An apparatus as set forth in claim 1 including a lower support plate, the lower support plate arranged in a parallel relationship relative to the bottom wall to position a cabinet between the support plate and the at least one abutment plate of said securement leg.

3. An apparatus as set forth in claim 2 wherein the securement leg includes a primary leg plate, the primary leg plate is defined by a first length and includes a first flange integrally and orthogonally mounted to a forward distal end of the primary leg plate extending upwardly therefrom, wherein the first flange is defined by a height equal to the predetermined height of the forward wall, and the first flange includes a second flange integrally and orthogonally mounted to an upper edge of the first flange extending forwardly thereof and is defined by a second width, and the mounting plate top wall is defined by a width equal to the second width, and a third flange integrally mounted to a forward edge of the second flange extending downwardly therefrom canted rearwardly thereof towards the first flange and is defined by a third flange width substantially less than a predetermined distance defined between the top wall and the mounting plate, and the top wall including a right abutment leg and a left abutment leg in a coplanar relationship relative to the top wall mounted to respective right and left distal ends of the top wall, with the right and left abutment legs projecting from the top wall towards the mounting plate.

4. An apparatus as set forth in claim 3 wherein the primary leg plate includes said at least first abutment plate integrally and orthogonally mounted downwardly therefrom, and a secondary leg plate integrally and orthogonally mounted to a lower terminal end of the said at least one abutment plate extending rearwardly thereof in a parallel relationship relative to the primary leg plate, and a second abutment plate integrally and orthogonally mounted to a rear distal end of the secondary leg plate extending downwardly therefrom in a parallel relationship relative to the said at least one abutment plate oriented below the at least one abutment plate, and a handle plate extending rearwardly of the second abutment plate.

5. An apparatus as set forth in claim 4 including an abutment plunger rod slidably directed through the said at least one abutment plate orthogonally oriented relative to the primary leg plate, wherein the abutment plunger rod includes a top flange mounted to an upper distal end of the plunger rod, and the bottom flange mounted to a lower distal end of the plunger rod, and a spring captured between the top flange and said at least one abutment plate to maintain the plunger rod in a raised orientation, and a plunger rod cavity radially directed into the plunger rod, and a locking lug slidably received within the plunger rod cavity, and a locking lug spring captured between the locking lug and the plunger rod cavity to bias the locking lug exteriorly of the plunger rod when the plunger rod is projected downwardly relative to the said at least one abutment plate.

6. An apparatus as set forth in claim 5 including a spirit level mounted to the mounting plate.

7. A cabinet mounting apparatus including an anchor plate spaced from and parallel a support plate to position a cabinet therebetween, the anchor plate including an enclosed slot longitudinally aligned within the anchor plate, the anchor plate including a cavity positioned rearwardly of a front wall, and an externally threaded boss directed through the slot, the boss including a fastener flange mounted to a forward distal end of the boss within the cavity, and a slide block, and the boss directed through the slide block, and a fastener member mounted to the boss exteriorly of the slide block to lock the slide block relative to the front wall of the anchor plate, and a hinge mounted to the slide block, and a mounting leg mounted to the hinge, and the mounting leg including a leg flange integrally mounted to a forward distal end of the mounting leg spaced from the front wall to position the cabinet in abutment with the flange and mounted between the anchor plate and the support plate.

8. A cabinet mounting apparatus as set forth in claim 3 wherein the primary leg plate includes an elongate slot, and includes parallel side edges, wherein the slot is arranged medially and parallel between the parallel side edges, and the slot includes the at least first abutment plate slidably mounted relative to the slot, the at least one abutment plate includes a support flange extending rearwardly relative to the abutment plate defining an oblique included angle therebetween, wherein the support flange extends for communication with a bottom surface of the primary leg plate, and the abutment plate includes an abutment plate extension projecting above a top surface of the primary leg plate, the abutment plate extension includes a threaded bore directed therethrough, and an exernally threaded rod orthogonally directed through the abutment plate extension complementarily received through the abutment plate extension, and a primary leg plate flange arranged parallel relative to the abutment plate extension integrally and orthogonally mounted to a rear distal end of the primary leg plate extending upwardly thereto, wherein the externally threaded rod is rotatably received orthogonally through the primary leg plate flange.

* * * * *